US010415159B2

(12) United States Patent
Yano

(10) Patent No.: US 10,415,159 B2
(45) Date of Patent: Sep. 17, 2019

(54) YARN MANUFACTURING DEVICE

(71) Applicant: Murata Machinery, Ltd., Kyoto-shi, Kyoto (JP)

(72) Inventor: Fumiaki Yano, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 781 days.

(21) Appl. No.: 14/902,310

(22) PCT Filed: Jul. 5, 2013

(86) PCT No.: PCT/JP2013/068535
§ 371 (c)(1),
(2) Date: Dec. 30, 2015

(87) PCT Pub. No.: WO2015/001668
PCT Pub. Date: Jan. 8, 2015

(65) Prior Publication Data

US 2016/0201230 A1 Jul. 14, 2016

(51) Int. Cl.
*D02G 3/16* (2006.01)
*D06M 15/00* (2006.01)
*D01H 1/115* (2006.01)

(52) U.S. Cl.
CPC ..... *D02G 3/16* (2013.01); *D01H 1/115* (2013.01); *D06M 15/00* (2013.01); *D10B 2101/122* (2013.01)

(58) Field of Classification Search
CPC ..... D01H 1/115; D01H 15/002; D02G 3/16
See application file for complete search history.

(56) References Cited

U.S. PATENT DOCUMENTS 3,783,596 A * 1/1974 Waldkirch ..... D06B 1/08 28/272
4,064,684 A * 12/1977 Nijhuis ..... D01H 1/115 57/296

(Continued)

FOREIGN PATENT DOCUMENTS

JP 6342008 B2 8/1988
JP S64-068525 A 3/1989

(Continued)

OTHER PUBLICATIONS

Extended European Search Report dated Jan. 17, 2017 for corresponding European Application 13 888 606.4 cites the foreign documents listed above.

(Continued)

*Primary Examiner* — Shaun R Hurley
(74) *Attorney, Agent, or Firm* — DLA Piper LLP (US)

(57) ABSTRACT

A yarn producing apparatus that produces carbon nanotube yarn at high speed includes a yarn producing unit that aggregates running carbon nanotube fibers. The yarn producing unit includes a nozzle body, a first nozzle provided in the nozzle body to generate a first swirl flow, with compressed air, in a direction orthogonal to the direction of the carbon nanotube fibers running, and a second nozzle provided in the nozzle body to generate a second swirl flow, with compressed air, in a direction orthogonal to the direction of the carbon nanotube fibers running and opposite to the direction of the first swirl flow. The first nozzle and the second nozzle are provided at positions different in the direction of the carbon nanotube fibers running in the nozzle body.

11 Claims, 7 Drawing Sheets

(56) References Cited

U.S. PATENT DOCUMENTS

| | | | | |
|---|---|---|---|---|
| 4,624,102 | A * | 11/1986 | Bell, Jr. | D01F 11/14 423/447.1 |
| 4,642,978 | A | 2/1987 | Murata | |
| 5,193,335 | A * | 3/1993 | Mori | D01H 1/115 57/296 |
| 9,945,053 | B2 * | 4/2018 | Yano | D02G 3/16 |
| 2007/0166223 | A1 * | 7/2007 | Jiang | B82Y 30/00 423/447.1 |
| 2008/0170982 | A1 * | 7/2008 | Zhang | B82Y 10/00 423/447.3 |
| 2016/0201229 | A1 * | 7/2016 | Yano | D01H 1/115 57/333 |

FOREIGN PATENT DOCUMENTS

| | | | |
|---|---|---|---|
| JP | H06-033332 | A | 2/1994 |
| WO | 2008022129 | A2 | 2/2008 |

OTHER PUBLICATIONS

International Preliminary Report on Patentability (Chapter 1 of the Patent Cooperation Treaty) dated Jan. 14, 2016 issued in corresponding PCT Application PCT/JP2013/068535.

International Search Report dated Sep. 17, 2013 issued for corresponding PCT application PCT/JP2013/068535.

Office Action dated Aug. 2, 2016 issued in corresponding Chinese Patent Application No. 201380077747.0 cites the United States patent document above.

* cited by examiner

YARN MANUFACTURING DEVICE

CROSS REFERENCE TO RELATED APPLICATIONS

This application is a national stage of international application no. PCT/JP2013/068535, filed on July 5, 2013, which is incorporated herein by reference.

TECHNICAL FIELD

The present invention relates to a yarn producing apparatus for producing carbon nanotube yarn.

BACKGROUND ART

A known example of conventional carbon nanotube yarn producing apparatus is disclosed in Patent Literature 1. The yarn producing apparatus disclosed in Patent Literature 1 includes a spin zone provided on the upstream side in the direction of carbon nanotube fibers running for twisting the carbon nanotube fibers in one direction, and another spin zone provided on the downstream side from the former spin zone for twisting the carbon nanotube fibers in the opposite direction to the one direction.

CITATION LIST

Patent Literature

[Patent Literature 1] WO2008/22129

SUMMARY OF INVENTION

Technical Problem

Yarn producing apparatus that produces carbon nanotube yarn from carbon nanotube fibers is required to produce carbon nanotube yarn at high speed.

An object of the present invention is to provide a yarn producing apparatus capable of producing carbon nanotube yarn at high speed.

Solution to Problem

A yarn producing apparatus according to an aspect of the present invention produces carbon nanotube yarn from carbon nanotube fibers while allowing the carbon nanotube fibers to run. The yarn producing apparatus includes a yarn producing unit configured to aggregate the running carbon nanotube fibers. The yarn producing unit includes a nozzle body configured to allow the carbon nanotube fibers to pass through, a first nozzle provided in the nozzle body to generate a first swirl flow, with compressed air, in a direction orthogonal to a direction of the carbon nanotube fibers running, and a second nozzle provided in the nozzle body to generate a second swirl flow, with compressed air, in a direction orthogonal to the direction of the carbon nanotube fibers running and opposite to the direction of the first swirl flow. The first nozzle and the second nozzle are provided at positions different in the direction of the carbon nanotube fibers running in the nozzle body. The aforementioned swirl flow in the orthogonal direction includes a swirl flow that includes a swirl component in a direction orthogonal to the direction of the carbon nanotube fibers running. That is, when compressed air is generated in the direction of the carbon nanotube fibers running, if a swirl flow includes a swirl component in a direction orthogonal to the direction of the carbon nanotube fibers running, the swirl flow is encompassed by the present invention.

This yarn producing apparatus can produce carbon nanotube yarn formed of aggregated carbon nanotube fibers at high speed because the carbon nanotube fibers are twisted by a swirl flow. In the yarn producing apparatus, the first nozzle generates a first swirl flow, and the second nozzle generates a second swirl flow in the direction opposite to the direction of the first swirl flow. In the yarn producing apparatus with this configuration, the carbon nanotube fibers can be false-twisted and aggregated at high speed. The yarn producing apparatus is configured such that a swirl flow is generated by the compressed air to twist the carbon nanotube fibers. With this configuration, the twist state can be easily adjusted by adjusting the amount of compressed air. In the yarn producing apparatus, the first nozzle and the second nozzle are provided in the nozzle body to form a unit and provided at different positions in the direction of the carbon nanotube fibers running. This configuration can facilitate passage of the carbon nanotube fibers through the first nozzle and the second nozzle in the yarn producing apparatus.

In an embodiment, the first nozzle may be provided on the upstream side from the second nozzle in the direction of the carbon nanotube fibers running. The pressure of the compressed air for forming the first swirl flow may be lower than the pressure of the compressed air for forming the second swirl flow. As described above, in the configuration in which the first nozzle is provided on the upstream side from the second nozzle, the pressure of the compressed air for forming the first swirl flow is reduced, that is, the pressure of the compressed air for forming the second swirl flow is increased, so that the carbon nanotube fibers can be well false-twisted and aggregated.

In an embodiment, the first swirl flow generated in the first nozzle may mainly twine part of an outer layer of the carbon nanotube fibers, and the second swirl flow generated in the second nozzle may mainly false-twist the carbon nanotube fibers to aggregate the carbon nanotube fibers. In the yarn producing apparatus with this configuration, the carbon nanotube fibers can be well false-twisted and aggregated.

In an embodiment, the nozzle body may have an air escape portion between the first nozzle and the second nozzle. This configuration can eliminate or minimize the interference between the first swirl flow in the first nozzle and the second swirl flow in the second nozzle in the yarn producing apparatus. Disturbances in the swirl flow in each nozzle thus can be eliminated or minimized, leading to improvement in quality of carbon nanotube yarn.

In an embodiment, the air escape portion may be a notch cut in the nozzle body. In the yarn producing apparatus with this configuration, the nozzle body excluding the notch can minimize or eliminate scattering of the carbon nanotube fibers.

In an embodiment, the yarn producing apparatus may further include a cross-linking agent solution supply mechanism configured to supply a cross-linking agent solution to at least one of the first nozzle and the second nozzle. In the yarn producing apparatus with this configuration, the swirl flow allows the cross-linking agent solution to effectively adhere to the carbon nanotube fibers. In the yarn producing apparatus, therefore, the carbon nanotube fibers can be cross-linked by the cross-linking agent solution. The yarn producing apparatus thus can produce excellent carbon nanotube yarn. In particular, when the cross-linking agent solution is supplied to the first nozzle, the solvent can be efficiently vaporized by the second flow in the second nozzle on the downstream side.

In an embodiment, the yarn producing apparatus may further include a cross-linking accelerating emission device for producing a chemical reaction of the cross-linking agent solution. In the yarn producing apparatus with this configuration, the carbon nanotube fibers can be cross-linked more effectively.

In an embodiment, the yarn producing apparatus may further include a coagulant supply mechanism configured to supply a coagulant to at least one of the first nozzle and the second nozzle. In the yarn producing apparatus with this configuration, the false-twisted carbon nanotube fibers can be aggregated efficiently. In the yarn producing apparatus with this configuration, the first swirl flow allows the coagulant to effectively adhere to the carbon nanotube fibers. The yarn producing apparatus thus can produce excellent carbon nanotube yarn. In particular, when the coagulant is supplied to the first nozzle, the coagulant can be efficiently vaporized by the second swirl flow in the second nozzle on the downstream side.

Advantageous Effects of Invention

The present invention can increase the speed of producing carbon nanotube yarn.

DESCRIPTION OF EMBODIMENTS

Preferred embodiments of the present invention will be described in detail below with reference to the accompanying drawings. It should be noted that the same or corresponding elements are denoted with the same reference signs in the description of the drawings and an overlapping description will be omitted.

[First Embodiment]

Figure 1:
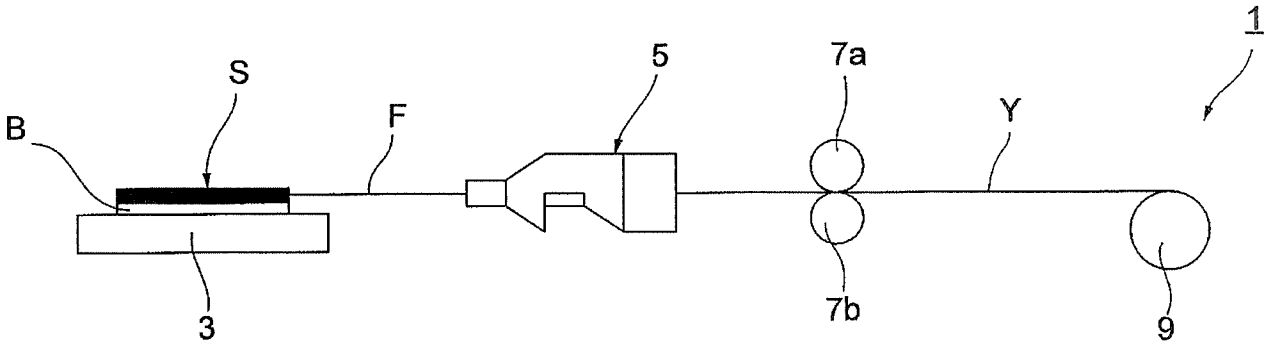
FIG. 1 is a diagram illustrating a yarn producing apparatus according to a first embodiment.
Figure 2:
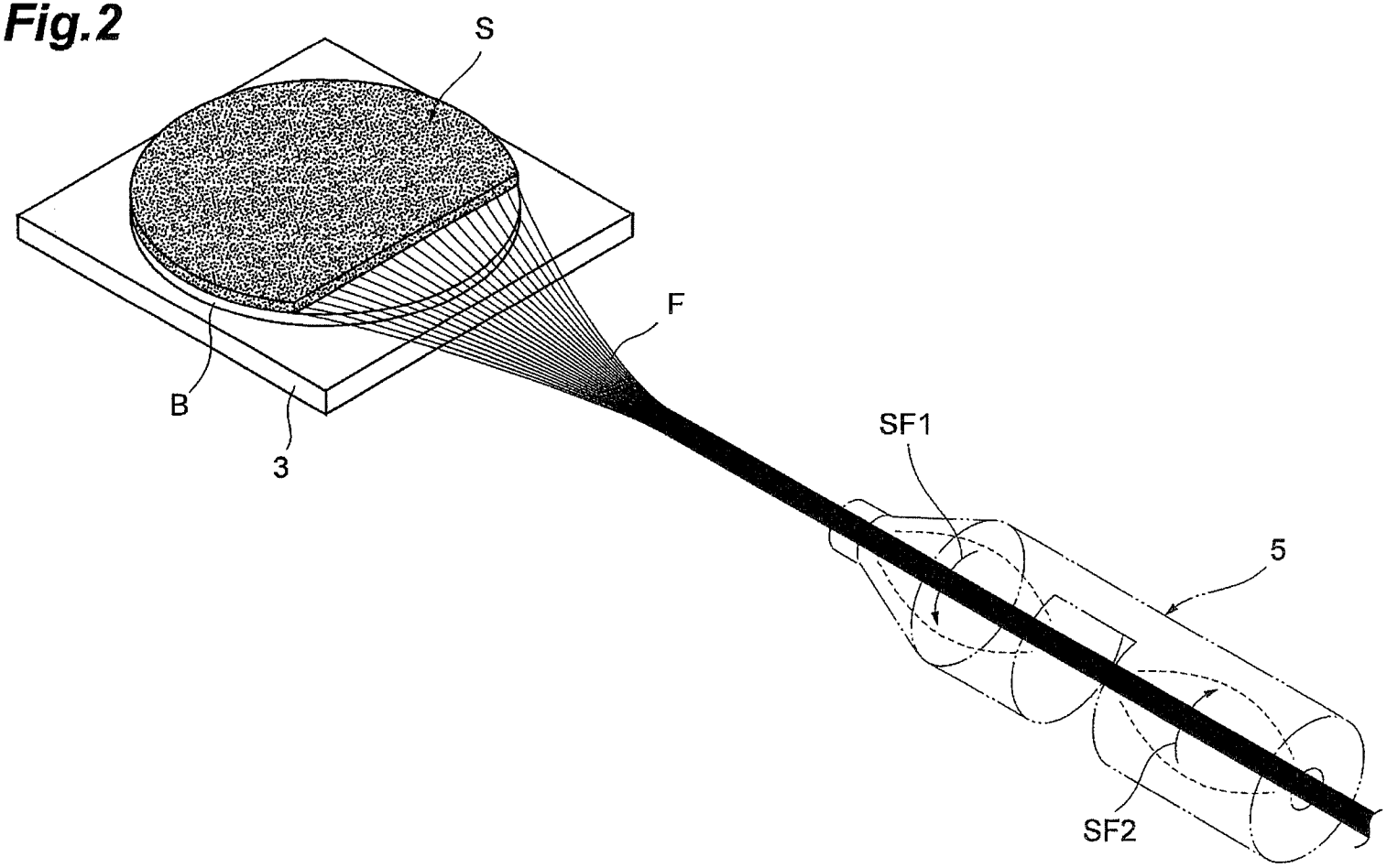
FIG. 2 is a partial perspective view of the yarn producing apparatus shown in FIG. 1.

FIG. 1 is a diagram illustrating a yarn producing apparatus according to a first embodiment. FIG. 2 is a partial perspective view of the yarn producing apparatus shown in FIG. 1. As shown in the drawings, the yarn producing apparatus 1 is an apparatus that produces carbon nanotube yarn (hereinafter referred to as "CNT yarn") Y from carbon nanotube fibers (hereinafter referred to as "CNT fibers") F while allowing the CNT fibers F to run.

The yarn producing apparatus 1 includes a substrate support 3, a yarn producing unit 5, nip rollers 7*a*, 7*b*, and a winding device 9. The substrate support 3, the yarn producing unit 5, the nip rollers 7*a*, 7*b*, and the winding device 9 are arranged in this order on a predetermined line. The CNT fibers F run from the substrate support 3 toward the winding device 9. The CNT fibers F are a set of a plurality of fibers of carbon nanotube. The CNT yarn Y is the false-twisted and aggregated CNT fibers F.

The substrate support 3 supports a carbon nanotube-forming substrate (hereinafter referred to as "CNT forming substrate") S from which the CNT fibers F are drawn, in a state of holding the CNT forming substrate S. The CNT forming substrate S is called a carbon nanotube forest or a vertically aligned carbon nanotube structure, in which high-density and high-oriented carbon nanotubes (for example, single-wall carbon nanotubes, double-wall carbon nanotubes, or multi-wall carbon nanotubes) are formed on a substrate B by chemical vapor deposition or any other process. Examples of the substrate B include a plastic substrate, a glass substrate, a silicon substrate, and a metal substrate. For example, at the start of production of CNT yarn Y or during replacement of the CNT forming substrates S, a tool called a microdrill can be used to draw the CNT fibers F from the CNT forming substrate S.

Figure 3:
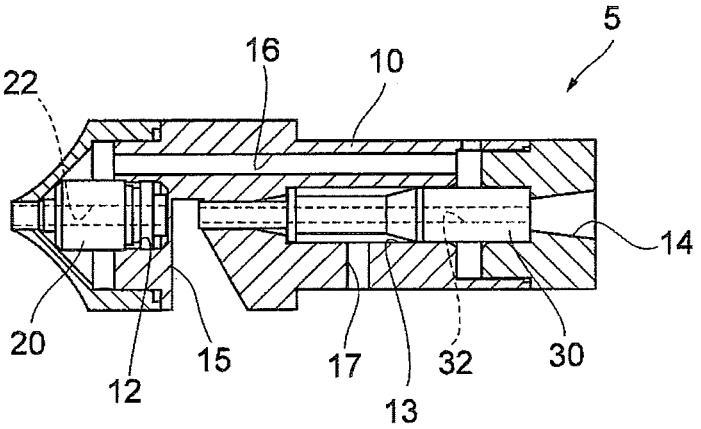
FIG. 3 is a diagram illustrating a yarn producing unit.
Figure 4:
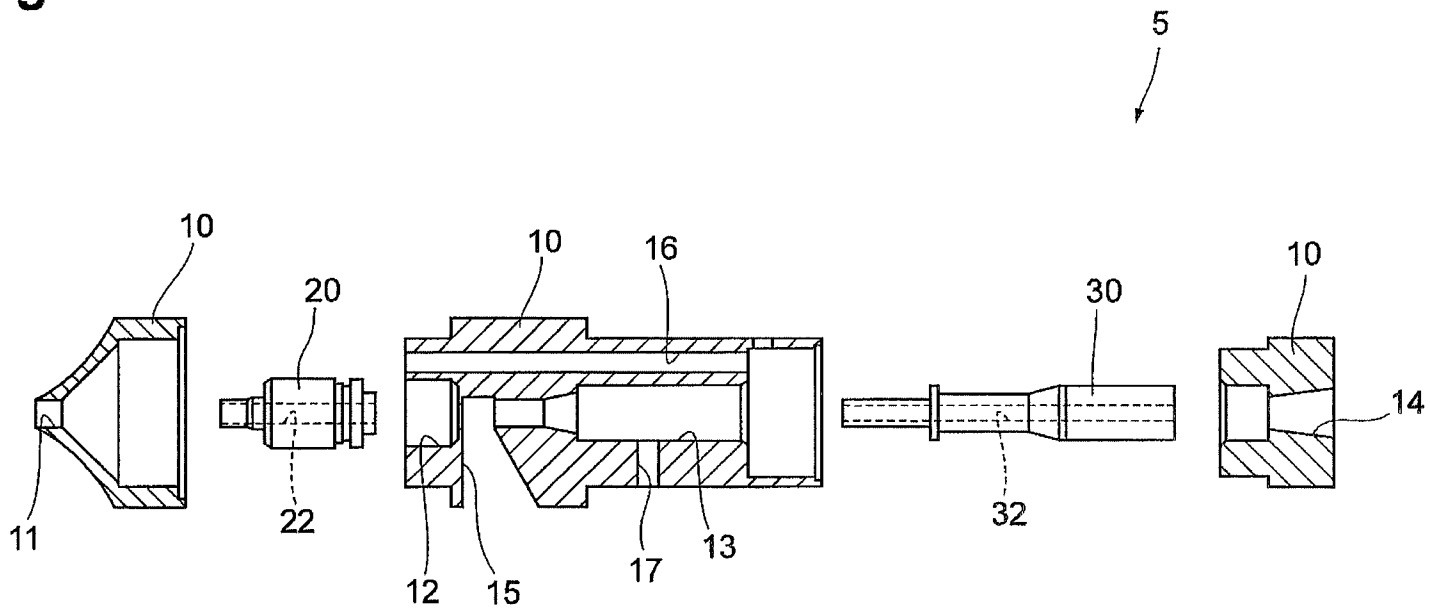
FIG. 4 is an exploded view of the yarn producing unit shown in FIG. 3.

The yarn producing unit 5 false-twists the CNT fibers F with a swirl flow of the compressed air (air) to aggregate the CNT fibers F. FIG. 3 is a diagram illustrating the yarn producing unit. FIG. 4 is an exploded view of the yarn producing unit shown in FIG. 3. In FIG. 3 and FIG. 4, a nozzle body 10 is illustrated in cross section. As shown in FIG. 3 and FIG. 4, the yarn producing unit 5 includes a nozzle body 10, a first nozzle 20, and a second nozzle 30. The first nozzle 20 and the second nozzle 30 are provided in the nozzle body 10. The nozzle body 10, the first nozzle 20, and the second nozzle 30 form a unit.

The nozzle body 10 is a housing that allows the CNT fibers F to pass through and holds the first nozzle 20 and the second nozzle 30 therein. The nozzle body 10 is formed of, for example, brass or any other material. The nozzle body 10 has an inlet 11 that allows the CNT fibers F to pass through and through which the CNT fibers F are introduced into the nozzle body 10, a first compartment 12 that accommodates the first nozzle 20, a second compartment 13 that accommodates the second nozzle 30, and an outlet 14 that allows the CNT fibers F to pass through and through which the CNT fibers F are output from the nozzle body 10. The first compartment 12 and the second compartment 13 are arranged in the direction of the CNT fibers F running.

The first compartment 12 is provided on one end in the direction of the CNT fibers F running (the position on the upstream side in the direction of the CNT fibers F running, in the yarn producing unit 5 arranged as shown in FIG. 1). The second compartment 13 is provided on the other end in the direction of the CNT fibers F running (the position on the downstream side from the first compartment 12, in the yarn producing unit 5 arranged as shown in FIG. 1).

An air escape portion 15 is arranged between the first compartment 12 and the second compartment 13. The air escape portion 15 lets out a first swirl flow SF1 generated in the first nozzle 20. The air escape portion 15 is a notch cut in the nozzle body 10. The air escape portion 15 is provided so as to include a path through which the CNT fibers F run. The path of the CNT fibers F between the first compartment 12 and the second compartment 13 is in communication with the air escape portion 15 and is partially covered with the nozzle body 10.

The nozzle body 10 has a first channel 16 and a second channel 17. The first channel 16 is a channel in communication with the first compartment 12 to supply the compressed air to the first nozzle 20. The second channel 17 is a channel in communication with the second compartment 13 to supply the compressed air to the second nozzle 30.

Although the nozzle body 10 is configured with a plurality of (here, three) parts in the present embodiment, the nozzle body 10 may be formed in one piece.

The first nozzle 20 generates a first swirl flow SF1 to form a balloon in the CNT fibers F and twist the CNT fibers F. The first nozzle 20 is formed of, for example, ceramics. The first nozzle 20 is arranged in the first compartment 12 of the nozzle body 10. The first nozzle 20 has a tubular portion 22 that allows the CNT fibers F to pass through and defines a space in which the first swirl flow SF1 is generated. The tubular portion 22 is provided in the direction of the CNT fibers F running.

Figure 5:
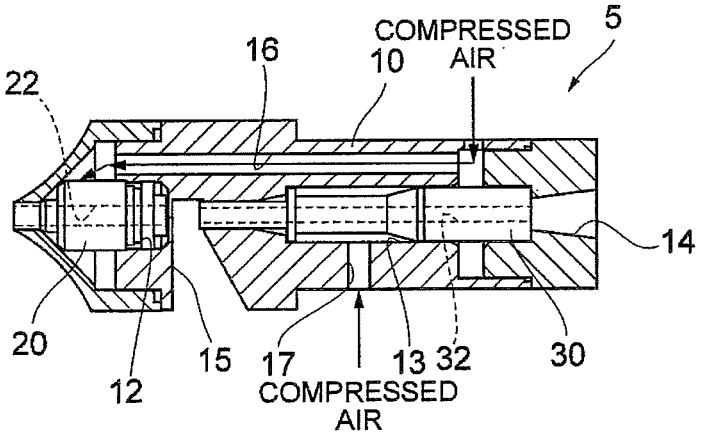
FIG. 5 is a diagram illustrating air flows in the yarn producing unit.

The first nozzle 20 is supplied with the compressed air from a not-shown air supply source through the first channel 16 in the nozzle body 10, as shown in FIG. 5. In the first nozzle 20, as shown in FIG. 2, a first swirl flow SF1 is generated in the direction orthogonal to the direction of the CNT fibers F running, for example, counterclockwise around the running direction. The first swirl flow SF1 is generated along the inner wall of the tubular portion 22. The first swirl flow SF1 mainly twines the outside fibers (part of the outer layer) of the CNT fibers F, around the inside fibers. The pressure (static pressure) of the compressed air for forming the first swirl flow SF1 is, for example, about 0.25 MPa.

The second nozzle 30 generates a second swirl flow SF2 to form a balloon in the CNT fibers F and twist the CNT fibers F. The second nozzle 30 is formed of, for example, ceramics. The second nozzle 30 is arranged in the second compartment 13 of the nozzle body 10. The second nozzle 30 has a tubular portion 32 that allows the CNT fibers F to pass through and defines a space in which the second swirl flow SF2 is generated. The tubular portion 32 is provided in the direction of the CNT fibers F running.

The second nozzle 30 is supplied with the compressed air from a not-shown air supply source through the second channel 17 in the nozzle body 10, as shown in FIG. 5. In the second nozzle 30, as shown in FIG. 2, a second swirl flow SF2 is generated in the direction orthogonal to the direction of the CNT fibers F running and opposite to the direction of the first swirl flow SF1, for example, clockwise around the running direction. That is, the direction of the second swirl flow SF2 is opposite to the direction of the first swirl flow SF1. The second swirl flow SF2 is generated along the inner wall of the tubular portion 32. The second swirl flow SF2 mainly twists the core (the inside fibers) of the CNT fibers F in the direction opposite to the direction of the first swirl flow SF1. The pressure (static pressure) of the compressed air for forming the second swirl flow SF2 is, for example, about 0.4 to 0.6 MPa. That is, the pressure of the compressed air for forming the second swirl flow SF2 is higher than the pressure of the compressed air for forming the first swirl flow SF1. In other words, the pressure of the compressed air for forming the first swirl flow SF1 is lower than the pressure of the compressed air for forming the second swirl flow SF2.

The nip rollers 7*a*, 7*b* convey the aggregated CNT yarn Y false-twisted by the yarn producing unit 5. A pair of nip rollers 7*a*, 7*b* is arranged at a position at which the CNT yarn Y is sandwiched. The nip rollers 7*a*, 7*b* stop the twisting (balloon) of the CNT fibers F that propagates from the yarn producing unit 5. The CNT fibers F false-twisted by the yarn producing unit 5 pass through the nip rollers 7*a*, 7*b* to be further aggregated, yielding the CNT yarn Y, which is the final product.

The winding device 9 winds, around a bobbin, the CNT yarn Y that has been false-twisted by the yarn producing unit 5 and passed through the nip rollers 7*a*, 7*b*.

The operation of false-twisting of the CNT fibers F in the yarn producing unit 5 will now be described. First, the CNT fibers F drawn from the CNT forming substrate S start being twisted by the second swirl flow SF2 in the second nozzle 30 in the yarn producing unit 5. The aggregated CNT fibers F twisted by the second swirl flow SF2 are untwisted by the first swirl flow SF1 in the first nozzle 20. Part (outer surface) of the CNT fibers F not aggregated by the second swirl flow SF2 is twined around the aggregated surface by the first swirl flow SF1 in the first nozzle 20. The yarn producing unit 5 thus aggregates the CNT fibers F. The yarn producing apparatus 1 produces CNT yarn Y, for example, at a rate of a few tens of meters per minute.

As described above, the yarn producing apparatus 1 according to the present embodiment can produce the CNT yarn Y from the CNT fibers at high speed because the CNT fibers F are twisted by a swirl flow of the compressed air. In the yarn producing apparatus 1, the first nozzle 20 generates a first swirl flow SF1, and the second nozzle 30 generates a second swirl flow SF2 in the direction opposite to the direction of the first swirl flow SF1. With this configuration, the yarn producing apparatus 1 can false-twist the CNT fibers F stably at high speed.

In the yarn producing apparatus 1, a swirl flow is generated by the compressed air to false-twist the CNT fibers F. With this configuration, the twist state can be easily adjusted by adjusting the amount of compressed air. In the yarn producing apparatus 1, the first nozzle 20 and the second nozzle 30 are each provided in the nozzle body 10 to form a unit and are arranged at different positions in the direction of the CNT fibers F running. This configuration can facilitate passage of the CNT fibers F through the first nozzle 20 and the second nozzle 30 in the yarn producing apparatus 1.

In the present embodiment, the first nozzle 20 is arranged on the upstream side from the second nozzle 30 in the direction of the CNT fibers F running In such a configuration, the pressure of the compressed air for forming the first swirl flow SF1 is lower than the pressure of the compressed air for forming the second swirl flow SF2. In the yarn producing apparatus 1 with this configuration, the first swirl flow SF1 generated in the first nozzle 20 mainly twines the fuzz on the outside of the CNT fibers F, whereas the second swirl flow SF2 generated in the second nozzle 30 mainly twists the CNT fibers F. In the yarn producing apparatus 1, therefore, the CNT fibers F can be false-twisted excellently.

In the present embodiment, the air escape portion 15 is provided between the first nozzle 20 and the second nozzle 30 in the nozzle body 10. The air escape portion 15 is a notch cut in the nozzle body 10. This configuration can eliminate or minimize the interference between the first swirl flow SF1 in the first nozzle 20 and the second swirl flow SF2 in the second nozzle 30 in the yarn producing unit 5. In the yarn producing unit 5, therefore, disturbances in swirl flows SF1, SF2 in the nozzles 20, 30, respectively, can be minimized or eliminated, leading to improvement in the quality of the CNT yarn Y In the yarn producing unit 5, the nozzle body 10 excluding the air escape portion 15 can eliminate or minimize scattering of the CNT fibers F.

[Second Embodiment]

Figure 6:
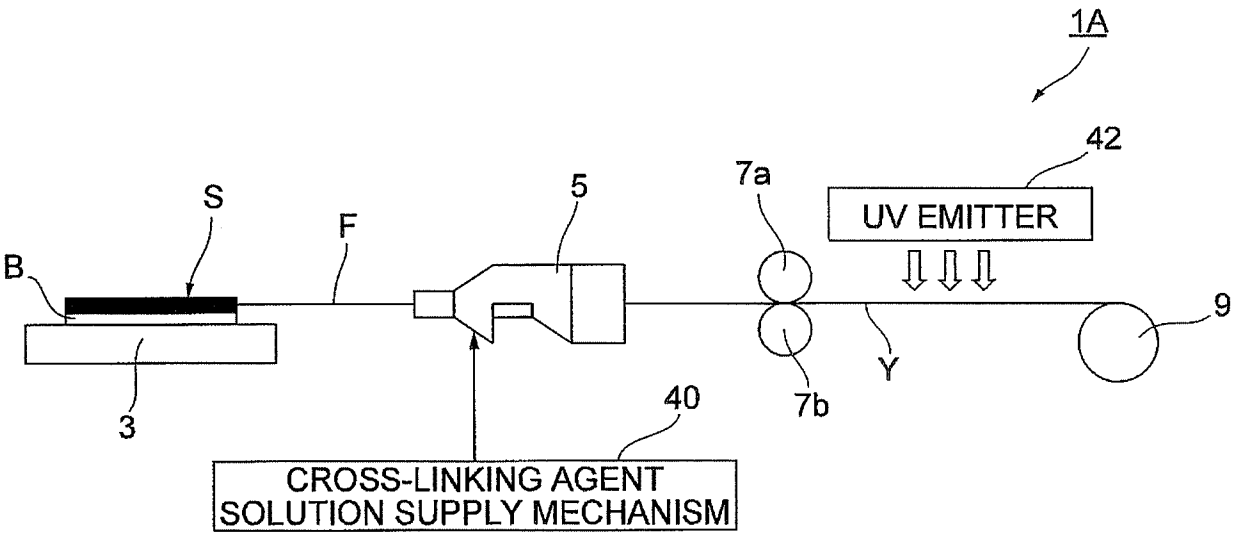
FIG. 6 is a diagram illustrating a yarn producing apparatus according to a second embodiment.

A second embodiment will now be described. FIG. 6 is a diagram illustrating a yarn producing apparatus according to the second embodiment. As shown in FIG. 6, a yarn producing apparatus 1A includes the substrate support 3, the yarn producing unit 5, the nip rollers 7*a*, 7*b*, and the winding device 9, and further includes a cross-linking agent solution supply mechanism 40 and a UV emitter 42 serving as a cross-linking accelerating emission device.

The cross-linking agent solution supply mechanism 40 supplies a cross-linking agent solution to the yarn producing unit 5. The cross-linking agent solution supply mechanism 40 supplies a cross-linking agent solution to, for example, the first nozzle 20. In the first nozzle 20, the cross-linking agent solution supplied by the cross-linking agent solution supply mechanism 40 is injected together with the compressed air and added to the first swirl flow SF1, adhering to the CNT fibers F. Any cross-linking agent can be used as long as it foams a cross-linking structure between carbon nanotube molecules. The cross-linking agent solution is prepared by dissolving a cross-linking agent in a volatile solvent (for example, ethanol or acetone).

The UV emitter 42 emits ultraviolet (UV) rays to the CNT yarn Y. The UV emitter 42 is arranged between the nip rollers 7*a*, 7*b* and the winding device 9 to emit UV rays to the CNT yarn Y passed through the nip rollers 7*a*, 7*b*. The UV emitter 42 accelerates the cross-linking on the CNT yarn Y by emitting UV rays to the CNT yarn Y with the adhering cross-linking agent solution.

As described above, in the yarn producing apparatus 1A according to the present embodiment, the cross-linking agent solution supply mechanism 40 supplies a cross-linking agent solution to the first nozzle 20 in the yarn producing unit 5. In the yarn producing apparatus 1 A with this configuration, the first swirl flow SF1 allows the cross-linking agent solution to adhere to the CNT fibers F. In the yarn producing apparatus 1A, therefore, the CNT fibers F can be cross-linked. In the yarn producing apparatus 1A, the UV emitter 42 emits UV rays to the CNT yarn Y after the cross-linking agent solution adheres to the CNT fibers F through the cross-linking agent solution supply mechanism 40. This configuration can accelerate cross-linking of the CNT yarn Y in the yarn producing apparatus 1A.

In the foregoing embodiment, the UV emitter 42 for emitting UV rays has been described as an example of the cross-linking accelerating emission device. However, the cross-linking accelerating emission device may be an electronic beam emitter for emitting electronic beams. Any other emitter may be used as long as it can produce a chemical reaction of the cross-linking agent (cross-linking agent solution).

In the foregoing embodiment, the cross-linking agent solution supply mechanism 40 that supplies a cross-linking agent solution to the first nozzle 20 has been described, by way of example. However, the cross-linking agent solution supply mechanism 40 may supply a cross-linking agent solution to the second nozzle 30. Alternatively, the cross-linking agent solution supply mechanism 40 may supply a cross-linking agent solution to the first nozzle 20 and the second nozzle 30. When a cross-linking agent solution is supplied to the first nozzle 20, the solvent can be efficiently vaporized by the second swirl flow SF2 in the second nozzle 30 on the downstream side.

[Third Embodiment]

Figure 7:
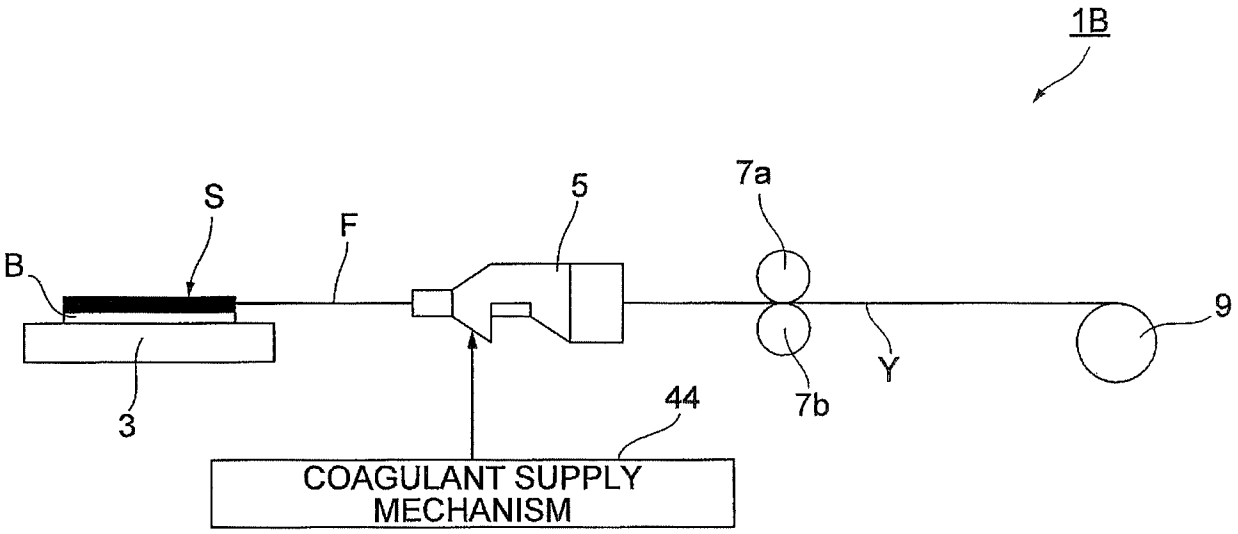
FIG. 7 is a diagram illustrating a yarn producing apparatus according to a third embodiment.

A third embodiment will now be described. FIG. 7 is a diagram illustrating a yarn producing apparatus according to the third embodiment. As shown in FIG. 7, a yarn producing apparatus 1B includes the substrate support 3, the yarn producing unit 5, the nip rollers 7*a*, 7*b*, and the winding device 9, and further includes a coagulant supply mechanism 44.

The coagulant supply mechanism 44 supplies a coagulant to the yarn producing unit 5. The coagulant supply mechanism 44 supplies a coagulant, for example, to the first nozzle 20. In the first nozzle 20, the coagulant supplied by the coagulant supply mechanism 44 is injected together with the compressed air and added to the first swirl flow SF1, adhering to the CNT fibers F. Any coagulant can be used as long as it forms an aggregate structure between carbon nanotube molecules. Examples of the coagulant include volatile organic compounds (for example, ethanol, acetone, chlorofluorocarbons, toluene, and dichloromethane).

As described above, in the yarn producing apparatus 1B according to the present embodiment, the coagulant supply mechanism 44 supplies a coagulant to the first nozzle 20 in the yarn producing unit 5. In the yarn producing apparatus 1B with this configuration, the first swirl flow SF1 allows the coagulant to adhere to the CNT fibers F. In the yarn producing apparatus 1B, therefore, the CNT fibers F can be aggregated excellently.

In the foregoing embodiment, the coagulant supply mechanism 44 that supplies a coagulant to the first nozzle 20 has been described, by way of example. However, the coagulant supply mechanism 44 may supply a coagulant to the second nozzle 30. Alternatively, the coagulant supply mechanism 44 may supply a coagulant to the first nozzle 20 and the second nozzle 30. When a coagulant is supplied to the first nozzle 20, the coagulant can be efficiently vaporized by the second swirl flow SF2 in the second nozzle 30 on the downstream side.

The present invention is not intended to be limited to the foregoing embodiments. In place of the CNT forming substrate S, for example, a floating catalyst apparatus that continuously synthesizes carbon nanotubes to supply the CNT fibers F may be used as the supply source of the CNT fibers F.

In the foregoing embodiments described by way of example, the pressure of the compressed air for forming the first swirl flow SF1 is set lower than the pressure of the compressed air for forming the second swirl flow SF2. However, the respective pressures of the compressed airs for forming the first swirl flow and for forming the second swirl flow SF2 may be equal. Alternatively, the pressure of the compressed air for forming the second swirl flow SF2 may be set lower than the pressure of the compressed air for forming the first swirl flow SF1.

In the foregoing embodiments, the configuration in which the first nozzle 20 and the second nozzle 30 are arranged in the nozzle body 10 has been described, by way of example. However, the first nozzle and the second nozzle may be spaces formed in the nozzle body 10. That is, the configuration equivalent to the first nozzle 20 and the second nozzle 30 may be integrally formed in the nozzle body 10.

INDUSTRIAL APPLICABILITY

The present invention can provide a yarn producing apparatus capable of producing carbon nanotube yarn at high speed.

REFERENCE SIGNS LIST

1, 1A, 1B . . . yarn producing apparatus, 5 . . . yarn producing unit, 10 . . . nozzle body, 15 . . . air escape portion, 20 . . . first nozzle, 30 . . . second nozzle, 40 . . . cross-linking agent solution supply mechanism, 42 . . . UV emitter, 44 . . . coagulant supply mechanism, F . . . CNT fibers (carbon nanotube fibers), SF1 . . . first swirl flow, SF2 . . . second swirl flow, Y . . . CNT yarn (carbon nanotube yarn).

The invention claimed is:

1. A yarn producing apparatus for producing carbon nanotube yarn from carbon nanotube fibers while allowing the carbon nanotube fibers to run, the yarn producing apparatus comprising a yarn producing unit configured to aggregate the running carbon nanotube fibers, wherein the yarn producing unit includes a nozzle body configured to allow the carbon nanotube fibers to pass through, a first nozzle provided in the nozzle body to generate a first swirl flow, with compressed air, in a direction orthogonal to a running direction of the carbon nanotube fibers, wherein the compressed air is introduced into the first nozzle in the direction orthogonal to the running direction of the carbon nanotube fibers, a second nozzle provided in the nozzle body to generate a second swirl flow, with compressed air, in a direction orthogonal to the running direction of the carbon nanotube fibers and opposite to the direction of the first swirl flow, a cross-linking agent solution and a cross-linking agent solution supply mechanism configured to supply said cross-linking agent solution to at least one of the first nozzle and the second nozzle, and the first nozzle and the second nozzle are provided at positions different in the direction of the carbon nanotube fibers running in the nozzle body.

2. The yarn producing apparatus according to claim 1, wherein the first nozzle is provided on an upstream side from the second nozzle in the direction of the carbon nanotube fibers running, and a pressure of the compressed air for forming the first swirl flow is lower than a pressure of the compressed air for forming the second swirl flow.

3. The yarn producing apparatus according to claim 1, wherein the first swirl flow generated in the first nozzle mainly twines part of an outer layer of the carbon nanotube fibers, and the second swirl flow generated in the second nozzle mainly false-twists the carbon nanotube fibers to aggregate the carbon nanotube fibers.

4. The yarn producing apparatus according to claim 3, wherein the nozzle body has an air escape portion between the first nozzle and the second nozzle.

5. The yarn producing apparatus according to claim 4, wherein the air escape portion is a notch cut in the nozzle body.

6. The yarn producing apparatus according to claim 1, further comprising a cross-linking accelerating emission device for producing a chemical reaction of the cross-linking agent solution.

7. The yarn producing apparatus according to claim 6, further comprising a coagulant supply mechanism configured to supply a coagulant to at least one of the first nozzle and the second nozzle.

8. The yarn producing apparatus according to claim 1, wherein the first swirl flow generated in the first nozzle mainly twines part of an outer layer of the carbon nanotube fibers, and the second swirl flow generated in the second nozzle mainly false-twists the carbon nanotube fibers to aggregate the carbon nanotube fibers.

9. The yarn producing apparatus according to claim 8, wherein the nozzle body has an air escape portion between the first nozzle and the second nozzle.

10. The yarn producing apparatus according to claim 9, wherein the air escape portion is a notch cut in the nozzle body.

11. The yarn producing apparatus according to claim 1, further comprising a coagulant supply mechanism configured to supply a coagulant to at least one of the first nozzle and the second nozzle.

* * * * *